US005383771A

United States Patent [19]

Ghode et al.

[11] Patent Number: 5,383,771

[45] Date of Patent: Jan. 24, 1995

[54] AIR MOTOR WITH OFFSET FRONT AND REAR EXHAUSTS

[75] Inventors: Anil P. Ghode, Mundelein, Ill.; Thomas J. Diedrich, Racine; Raymond D. De Rome, Twin Lakes, both of Wis.

[73] Assignee: Snap-on Incorporated, Kenosha, Wis.

[21] Appl. No.: 169,414

[22] Filed: Dec. 20, 1993

[51] Int. Cl.[6] ..... F04C 2/00

[52] U.S. Cl. ..... 418/15; 418/86; 415/904

[58] Field of Search ..... 418/15, 86, 259; 415/904

[56] References Cited

U.S. PATENT DOCUMENTS

| | | | |
|---|---|---|---|
| 1,727,718 | 5/1926 | Kinsey . | |
| 2,575,524 | 11/1951 | Mitchell . | |
| 2,924,114 | 2/1960 | Hitt et al. | 415/904 |
| 3,190,183 | 6/1965 | Walker et al. . | |
| 3,465,646 | 9/1969 | Kiester et al. | 418/86 |
| 3,927,956 | 12/1975 | Linthicum . | |
| 3,934,657 | 1/1976 | Danielson . | |
| 4,068,987 | 1/1978 | Crooks . | |
| 4,187,063 | 2/1980 | Yoshida et al. . | |
| 4,412,795 | 11/1983 | Adams . | |
| 4,631,012 | 12/1986 | Eckman . | |
| 4,789,312 | 12/1988 | Gable . | |
| 4,822,264 | 4/1989 | Kettner . | |
| 4,962,787 | 10/1990 | Mayhew . | |
| 5,017,109 | 5/1991 | Albert et al. . | |
| 5,064,361 | 11/1991 | Kristof et al. . | |
| 5,074,750 | 12/1991 | Kakimoto | 415/904 |

FOREIGN PATENT DOCUMENTS

| | | | |
|---|---|---|---|
| 1681051 | 9/1991 | U.S.S.R. | 418/259 |

OTHER PUBLICATIONS

Snap-on Tools catalog p. 212, 1993.

Polaroid photographs of Japanese air motor.

*Primary Examiner*—Richard A. Bertsch

*Assistant Examiner*—Charles G. Freay

*Attorney, Agent, or Firm*—Emrich & Dithmar

[57] ABSTRACT

A rotary air motor has a liner disposed within a tool housing and having a cylindrical bore therethrough. A rotor having radially slidable vanes is eccentrically rotatably mounted in the bore by bearings in the plates of the liner, the vanes cooperating with the rotor and the liner to define a plurality of rotating variable volume fluid compartments. A fluid inlet port in one end plate communicates sequentially with the fluid compartments. First and second exhaust ports respectively formed in the end plates also communicate sequentially with the fluid compartments, but the two exhaust ports are angularly offset from each other so that the fluid compartments communicate first with the exhaust port remote from the entry end plate and then with the exhaust port at the entry end plate. The exhaust passage from the remote exhaust port passes along the outside of the liner back to the entry end plate, thereby ensuring cooling of both ends of the motor.

16 Claims, 2 Drawing Sheets

AIR MOTOR WITH OFFSET FRONT AND REAR EXHAUSTS

BACKGROUND OF THE INVENTION

1. Field of the Invention

The present invention relates to fluid powered motors and, more specifically, to the cooling of or dissipation of heat from such motors.

2. Description of the Prior Art

A wide variety of fluid-powered tools, such as air tools, utilize a rotary air motor which has a rotor mounted eccentrically in a circular bore in a cylindrical liner which may, in turn, be mounted in a tool housing. Movable vanes mounted radially in the rotor extend outwardly to contact the inner surface of the bore and provide sealing for the driving fluid, typically compressed air. Inlet and exhaust ports are provided in the housing to allow the driving fluid to enter the bore, drive the rotor and exhaust from the motor. The rotor is usually mounted in bearings in a pair of end plates at opposite ends of the liner. As the rotor rotates, the vanes cooperate with the liner to define a plurality of rotating and variable volume fluid chambers which sequentially communicate with the inlet and exhaust ports. In such motors, the driving fluid typically also serves to cool the motor.

The fluid typically enters at the rear end of the tool and motor. Heretofore, there have generally been two types of exhaust arrangements, viz., front exhaust and rear exhaust. In the front exhaust arrangement the fluid exits the motor at the front end thereof, i.e., the end which carries the output shaft, while in the rear exhaust arrangement, the fluid exits the motor at the rear end thereof, i.e., the same end that the fluid enters.

In typical rear exhaust air tools, the compressed air enters an air motor chamber and, after a predetermined angular rotation, which may be approximately 140°, the air exhausts from an exhaust port in the rear end plate. As the air motor operates, the rotor rotates at a relatively high speed, which may be approximately 20,000 rpm. The centrifugal force on the vanes drives them into frictional engagement with the cylindrical liner, generating heat. The rear exhaust motor provides good cooling of the rear end of the motor, since the compressed air is relatively cool when it enters and the expansion of the air upon exhausting back to atmospheric pressure provides a further cooling effect. However, this type of motor does not provide effective cooling of the front end of the motor. This results in a hot front end problem, wherein the front end of the motor may become sufficiently hot to give an operator first degree burns if he touches the front end of the tool and to cause front bearing lockup of the rotor.

The hot front end problem can be alleviated by the use of a front exhaust motor, wherein exhaust ports are provided at the front end of the tool, so that the expanding, exhausting air cools the front end of the tool. However, if air is exhausted only at the front end plate and not at the rear end plate, it generates a high back pressure, resulting in lowered motor output.

It is known to provide simultaneous exhaust at both the front and rear ends of the motor. While this tends to alleviate the back pressure problem, the majority of the air takes the shortest path to the rear exhaust port and exhausts through the rear end plate. Thus, such tools may still suffer from the hot front end condition.

SUMMARY OF THE INVENTION

It is a general object of the invention to provide an improved fluid-operated rotary motor which avoids the disadvantages of prior motors while affording additional structural and operating advantages.

An important feature of the invention is the provision of a fluid-operated motor of the type set forth which avoids excessive heating of the front end of the motor.

In connection with the foregoing feature, another feature of the invention is the provision of a motor of the type set forth which provides effective cooling or heat dissipation along the entire length of the motor.

Still another feature of the invention is the provision of a motor of the type set forth which avoids the buildup of excessive back pressure in the motor.

In connection with the foregoing features, another feature of the invention is the provision of a motor of the type set forth, which ensures sufficient exhausting of fluid from each end of the motor to ensure effective cooling thereof.

Yet another feature of the invention is the provision of an air motor of the type set forth, which affords sound damping.

These and other features of the invention are attained by providing in a fluid operated rotary motor including a liner having a cylindrical bore therethrough, a rotor having radially slidable vanes and being eccentrically mounted in the cylindrical bore, first and second end plates respectively mounted at first and second ends of the liner and rotatably supporting the rotor, and a fluid inlet port communicating with the interior of the cylindrical bore adjacent to the first end of the liner, the improvement comprising: exhaust structure defining first and second exhaust passages communicating with the bore respectively adjacent to the first and second ends of the liner, the exhaust structure including proportioning means for ensuring that substantial fluid is exhausted from the bore through each of the first and second exhaust passages.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
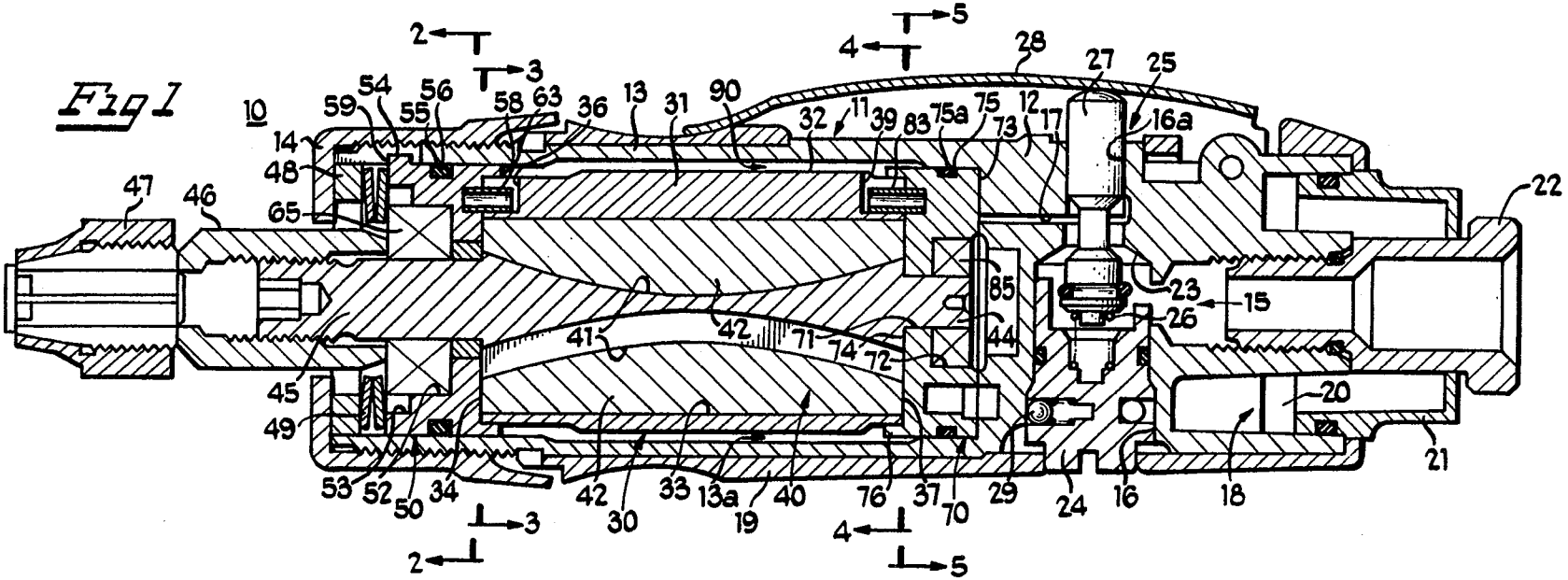
FIG. 1 is a view in vertical section through an air tool incorporating an air motor constructed in accordance with the present invention.
Figure 6:
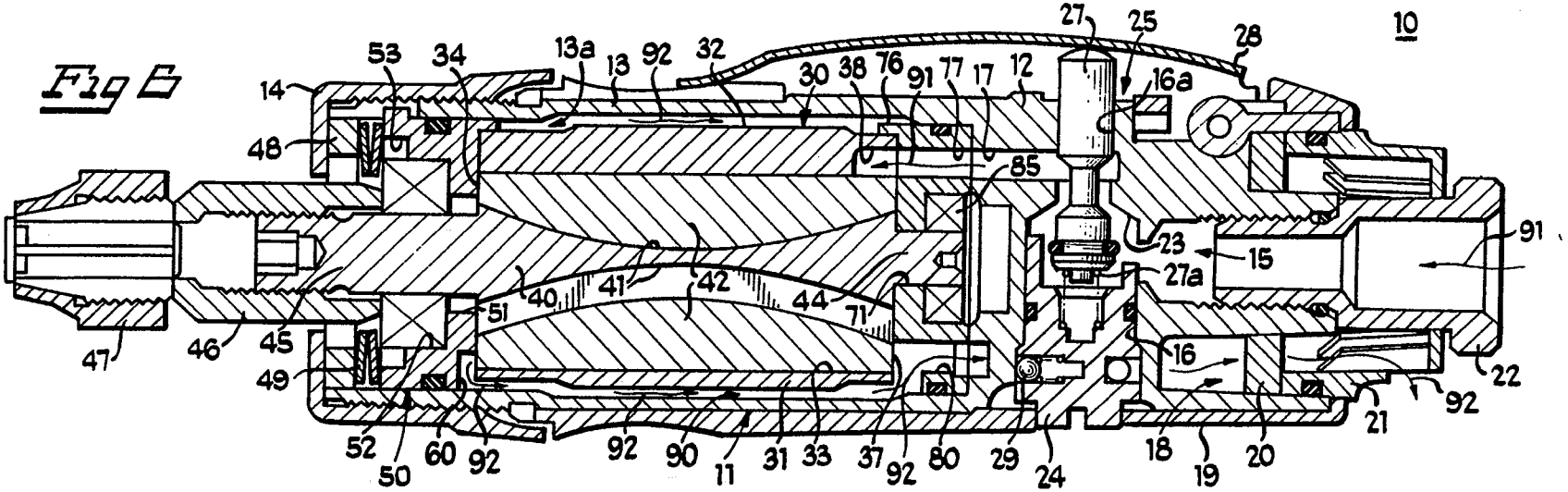
FIG. 6 is a view similar to FIG. 1, but taken through the inlet and outlet passages of the air motor.

Referring to FIGS. 1 and 6, there is illustrated an air tool, generally designated by the numeral 10, which incorporates an air motor assembly 30 constructed in accordance with and embodying the features of the present invention. The air tool 10 is illustrated as being a pneumatically operated die grinder, but it will be appreciated that the principles of the present invention are applicable to a wide variety of pneumatically operated tools. Hereinafter, the left-hand end of the air tool 10, as viewed in FIGS. 1 and 6, will be referred to as the front end and the right-hand end will be referred to as the rear end.

The air tool 10 includes an elongated, generally cylindrical housing 11 having a body block 12 at the rear end thereof and having a hollow forward end 13 defining a cavity 13*a* for the air motor assembly 30. The forward end 13 is threadedly engaged with a cap nut 14 for closing the cavity 13*a*. An axial air inlet passage 15 is formed in the rear end of the body block 12 and communicates with a diametrically extending valve bore 16. Also communicating with the bore 16 and projecting forwarding therefrom into the air motor cavity 13*a* is an inlet passage 17. Formed in the body block 12 generally circumferentially around the axial air inlet passage 15 is a generally annular air outlet passage 18. A jacket 19 is formed around the housing 11. Disposed in the annular air outlet passage 18 is an annular diffuser 20, against which is seated an annular deflector 21 for baffling and guiding the flow of exhaust air. Inlet air is supplied through an inlet bushing 22 which is threadedly engaged in the axial air inlet passage 15 and is adapted to be coupled to an associated source of pressurized air (not shown) in a known manner.

The air tool 10 is provided with a valve assembly 25 including a frustoconical valve seat 23 defining a transition between a large diameter lower portion of the valve base 16 and a reduced diameter upper portion 16*a* thereof. The valve assembly 25 also includes a regulator 24 seated in the lower end of the valve bore 16. The valve assembly 25 further includes an elongated valve stem 27 disposed in the reduced-diameter upper portion 16*a* of the valve bore 16 for engagement with an actuator handle 28, which is pivotally mounted at the rear end of the housing 11. The valve stem 27 is resiliently urged upwardly against the actuator handle 28 by a helical compression spring 27*a* (FIG. 6) seated in the regulator 24 for holding the valve assembly 25 in a normally closed position (not shown) against the valve seat 23, blocking the flow of inlet air from the air motor assembly 30. When the actuator handle 28 is depressed to an actuated position, illustrated in the drawings, the inlet valve is opened to permit the flow of inlet air through the regulator 24 to the air motor assembly 30. It will be appreciated that the regulator 24 is rotatable, as by a screwdriver, among a number of detent positions, being retained in each by a detent ball 29, for varying the size of the opening presented by the regulator 24 to the inlet passage 15.

Figure 4:
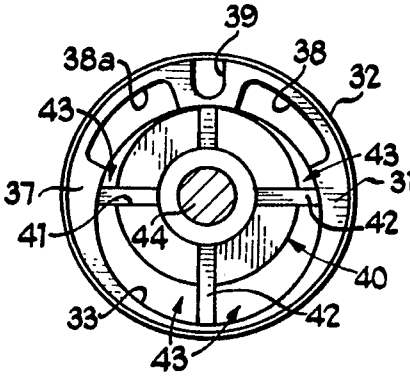
FIG. 4 is a rear elevational view of the liner of the air motor of FIG. 1, viewed along the line 4—4.
Figure 3:
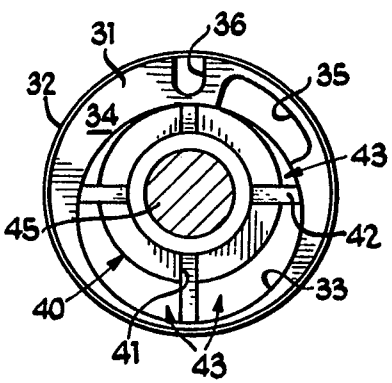
FIG. 3 is a front end elevational view of the liner of the air motor of FIG. 1, viewed along the line 3—3.
Figure 7:
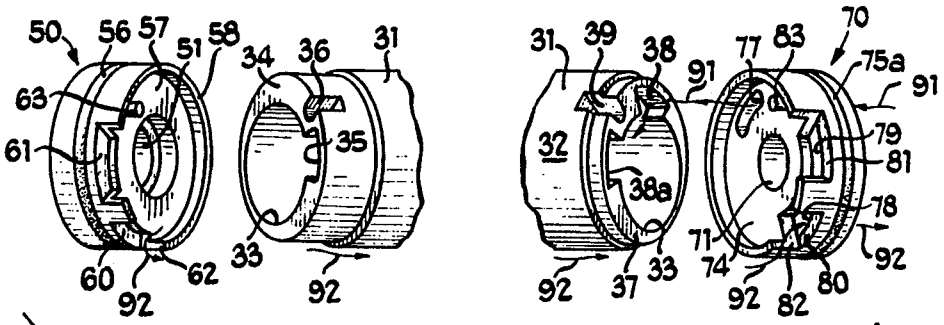
FIG. 7 is a reduced, fragmentary, exploded, perspective view illustrating the relationship of the end plates with the liner of the air motor of FIG. 1.

The air motor assembly 30 includes a cylindrical liner 31 disposed coaxially within the cavity 13*a* in the housing 11 and having an outer surface 32 spaced a predetermined distance radially inwardly from the hollow forward end 13 for cooperation therewith to define an annular chamber 90 therebetween. Referring also to FIGS. 3, 4 and 7, the liner 31 has an eccentric, circularly cylindrical bore 33 extending therethrough from the front end face 34, to the rear end face 37 thereof. Also formed in the front end face 34, radially outwardly of the bore 33 and communicating therewith, is an arcuate outlet recess 35. Formed in the front end face 34 adjacent to the outlet recess 35 and communicating with the outer surface 32 of the liner 31 is a pin recess 36. Formed in the rear end face 37 radially outwardly of the bore 33 and communicating therewith are circumferentially spaced-apart inlet and outlet recesses 38 and 38*a*. Formed in the rear end face 37 between the recesses 38 and 38*a* and communicating with the outer surface 32 of the liner 31 is a pin recess 39.

Disposed eccentrically within the bore 33 and coaxially with the liner 31 is an elongated cylindrical rotor 40, having four equiangularly spaced-apart radial slots 41 formed in the outer surface thereof, in which are respectively freely slidably disposed, four vanes 42. In operation, as the rotor 40 rotates (in a clockwise direction, as viewed in FIG. 4) the vanes 42 are urged by centrifugal force radially outwardly into sliding engagement with the liner 31 at the periphery of the bore 33, for cooperation therewith to define four rotating and variable volume compartments 43, all in a known manner. The rotor 40 has a rearwardly projecting hub 44 and a forwardly projecting output shaft 45 which, respectively, project rearwardly and forwardly beyond the rear and front end faces 37 and 34. The output shaft 45 projects axially outwardly beyond the cap nut 14 and has threadedly engaged therewith a collet 46 which is, in turn, threadedly engaged with a cap 47. Disposed within the cap nut 14 and in surrounding relationship with the output shaft 45 and the collet 46 are an annular spacer 48 and annular disk springs 49.

Figure 2:
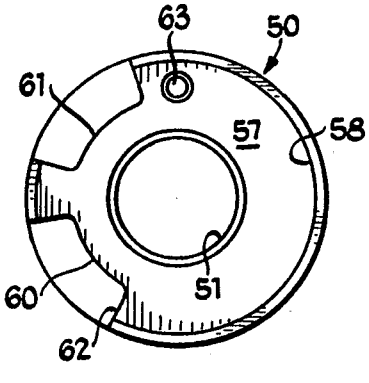
FIG. 2 is a rear elevational view of the front end plate of the air motor of FIG. 1, viewed along the line 2—2.

Referring also to FIGS. 2 and 7, the air motor assembly 30 includes a cylindrical front end plate 50 having an axial bore 51 therethrough. Formed in the front end of the end plate 50 are successively larger diameter counterbores 52 and 53. Projecting radially outwardly from the end plate 50 at the front end thereof is a locating tab 54 engaged in a slot in the housing 11 for rotational positioning. Formed in the outer surface of the end plate 50 is a circumferential groove 55, in which is disposed an O-ring 56. The end plate 50 has a rear end surface 57 and a front end surface 59. Projecting rearwardly from the rear end surface 57 at the outer periphery thereof is a generally annular flange 58. Formed in the outer surface of the front end plate 50 at the rear end thereof are two circumferentially spaced-apart arcuate cutouts 60 and 61, each extending axially from the rear edge of the flange 58 to a slight distance forwardly of the rear end surface 57, and each extending radially inwardly of the flange 58 a slight distance. The leading cutout 60 has a leading edge 62, i.e., the first edge which would be encountered in use by one of the rotating air compartments 43. Spaced circumferentially a slight distance from the cutout 61 in the direction of rotation of the air motor assembly 30 and projecting rearwardly from the rear end surface 57 is a locating pin 63, which extends axially a slight distance beyond the rear edge of the flange 58. Seated in the counterbore 52 is a ball-bearing assembly 65.

Figure 8:
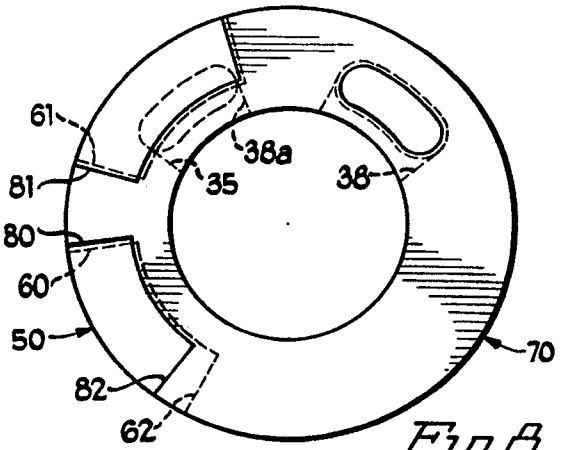
FIG. 8 is an enlarged, diagrammatic view of the air motor assembly of FIG. 1, viewed from the rear end thereof, illustrating the relationship of the inlet and outlet passages in the end plates.

In assembly, the front end plate 50 fits snugly within the front end of the cavity 13*a* of the housing 11, with the rear end surface 57 disposed against the front end face 34 of the liner 31, and with the flange 58 disposed in the annular chamber 90 between the liner 31 and the housing forward end 13. The O-ring 56 provides a seal between the front end plate 50 and the housing forward end 13. The rotor output shaft 45 is rotatably supported in the bearing assembly 65 and the disk springs 49 are compressed against the bearing assembly 65 and the front end surface 59 of the front end plate 50. It will be appreciated that the locating pin 63 is disposable in the pin recess 36 of the liner 31 for rotationally orienting the front end plate 50 relative to the liner 31 (see FIGS. 1 and 7), preventing relative rotation thereof. When thus oriented, the cutout 61 will be disposed for communication with the outlet recess 35 in the front end face 34 of the liner 31 (see FIGS. 7 and 8).

Figure 5:
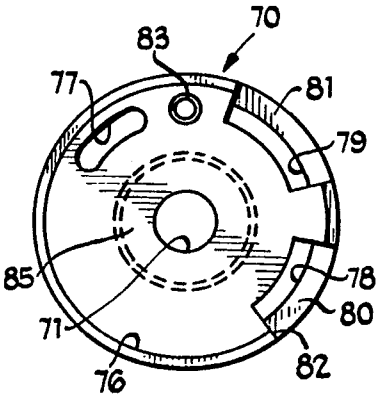
FIG. 5 is a front elevational view of the rear end plate of the motor of FIG. 1, viewed along the line 5—5.

Referring now in particular to FIGS. 5 and 7, the air motor assembly 30 also includes a generally cylindrical rear end plate 70, which has an axial bore 71 therethrough provided at the rear end thereof with a counterbore 72. The end plate 70 has a rear end surface 73 and a front end surface 74 and is provided in the outer cylindrical surface thereof with a circumferential groove 75, in which is seated an O-ring 75*a*. The front end surface 74 is recessed so as to define an annular forwardly extending flange 76. Extending through the rear end plate 70 in an axial direction and disposed radially just inside the flange 76 is an arcuate inlet port 77. Also formed through the rear end plate 70 in an axial direction are two circumferentially spaced-apart arcuate outlet ports 78 and 79. Formed in the outer surface of the rear end plate 70 and respectively communicating with the outlet ports 78 and 79, are two arcuate cutouts 80 and 81, each extending axially from the front edge of the flange 76 to a slight distance rearwardly of the front end surface 74, and each extending radially inwardly from the outer surface of the end plate 70 to the radially inner edge of the outlet ports 78 and 79. The cutout 80 has a leading edge 82, i.e., the edge which is, in use, first encountered by one of the rotating air compartments 43. Disposed between the inlet port 77 and the outlet port 79 and projecting forwardly from the front end surface 74 is a locating pin 83, which extends a slight distance forwardly beyond the front edge of the flange 76. A ball bearing assembly 85 is seated in the counterbore 72.

In assembly, the rear end surface 73 is seated against the body block 12 and the front end surface 74 is disposed against the rear end face 37 of the liner 31, with the flange 76 fitted snugly around the liner 31. The O-ring 75*a* is disposed in sealing relationship with the housing 11. The hub 44 of the rotor 40 is received through the bore 71 of the rear end plate 70 and is supported in the bearing assembly 85. The locating pin 83 is seated in the pin recess 39 for rotationally orienting the rear end plate 70 relative to the liner 31, preventing relative rotation thereof. When thus oriented, the inlet port 77 communicates with the inlet recess 38 of the liner 31 and the outlet port 79 communicates with the outlet recess 38*a* of the liner 31. Preferably, the rotor 40 is so dimensioned that when the air motor assembly 30 is assembled as illustrated in FIGS. 1 and 6, there will be a very slight axial clearance between the main body of the rotor 40 and the end plates 50 and 70 and between the ends of the vanes 42 and the end plates 50 and 70, thereby to accommodate free rotation of the rotor 40. It will be appreciated that the cap nut 14 cooperates with the disk springs 49 to resiliently urge the entire air motor assembly 30 rearwardly for cooperation with the body block 12 to firmly clamp the air motor assembly 30 axially in its assembled condition and firmly mounted in the housing 11.

It is a significant aspect of the present invention that the cutouts 60 and 61 in the front end plate 50 and the cutouts 80 and 81 in the rear end plate 70, provide communication between the compartments 43 of the air motor assembly 30 and the annular chamber 90 around the outside of the air motor assembly 30, thereby to provide an exhaust path for the air from the front end of the motor assembly 30 to the air outlet passage 18. In this regard, it will be appreciated that the air compartments 43 at the bottom of the bore 33, as viewed in FIGS. 3 and 4, have a substantial radial extent, extending nearly to the flanges 58 and 76 of the end plates 50 and 70, respectively. Thus, these lower compartments 43 communicate directly with the cutouts 60 and 80 of the front and rear end plates 50 and 70, respectively. However, because of the eccentric location of the bore 33, the air compartments 43 at the top thereof are spaced radially inwardly a significant distance. Thus, the outlet recesses 35 and 38*a* are provided in the liner 31 to ensure communication of one of the upper air compartments 43 with the cutouts 61 and 81 of the front and rear end plates 50 and 70, respectively, while the inlet recess 38 in the liner 31 provides communication between the other upper air compartment 43 with the air inlet port 77 in the rear end plate 70.

In operation, inlet air enters the axial air inlet passage 15 through the inlet bushing 22 and follows the path generally indicated by the inlet arrows 91 in FIGS. 6 and 7 into the valve assembly 25 and, when the valve is opened, upwardly into the inlet passage 17 and then forwardly through the inlet port 77 of the rear end plate 70, thence into the inlet recess 38 in the liner 31 and into the upper right one of the air compartments 43, as illustrated in FIG. 4. This air, which is under superatmospheric pressure, engages the adjacent vane 42 and drives the rotor 40 in a clockwise direction, as viewed in FIG. 4. It will be appreciated that, as the rotor 40 rotates, each of the air compartments 43 is brought, in succession, into communication with the air inlet path. Each of these compartments 43 is filled with compressed air along its entire axial extent.

As each of the compartments 43 rotates past the cutouts 60 and 61 and 80 and 81, air will be exhausted from both the front and rear ends of the air motor assembly 30 through front and rear exhaust passages. Normally, the bulk of the air would follow the shortest path from the inlet passage and would, therefore, exhaust through the rear exhaust passage. However, it is another significant aspect of the invention that the front exhaust passage is rotationally offset relative to the rear exhaust passage, so that each rotating air compartment 43 encounters the front exhaust passage before it encounters the rear exhaust passage. Thus, referring in particular to FIG. 8, it can be seen that the leading edge 62 of the front end plate cutout 60 leads the leading edge 82 of the rear end plate cutout 80 by a predetermined angle, preferably about 10°. Thus, the air from the air compartment 43 will encounter the front exhaust passage through the cutout 60 about 10° (i.e., about 1/36 the rotational period of the rotor) prior to its encounter with the rear exhaust passage through the cutout 80. Accordingly, air will start exhausting from the front of the air motor assembly 30, and, since the air will tend to follow an exhaust path, once established, a substantial portion of the air will continue to exhaust from the front of the air motor assembly 30 even after the compartment encounters the rear exhaust passage. Thus, there will be a substantial exhaust air flow through each of the front and rear exhaust passages. Accordingly, the end plates 50 and 70 cooperate with the liner to define proportioning means to ensure substantial exhaust from both ends of the air motor assembly 30.

It will be appreciated that the front exhaust passage encompasses both of the cutouts 60 and 61 and the annular chamber 90, while the rear exhaust passage encompasses both of the cutouts 80 and 81 and both of the outlet ports 78 and 79. The exhausting air will generally follow a path indicated by the exhaust arrows 92 in FIGS. 6 and 7. Thus, air exhausting from the rear end of the air motor assembly 30 will pass directly through the outlet ports 78 and 79 into the outlet passage 18, which extends around the regulator 24 in a known manner. Air exhausting from the front of the air motor assembly 30 will pass through the cutouts 60 and 61 into the annular chamber 90 along the outside of the air motor assembly 30 and will then flow rearwardly along the entire length of the air motor assembly 30 and then pass back through the cutouts 80 and 81 into the outlet ports 78 and 79 to join the rear exhaust stream. Thus, it will be appreciated that the rear end of the air motor assembly 30 will be effectively cooled because the incoming air is cool and the front end of the air motor assembly 30 will be effectively cooled as a result of its expansion as it passes from the air compartment 43 into the front exhaust passage. It will also be appreciated that the air in the front exhaust passage tends to cool the air motor assembly 30 along its entire length.

In a constructional model of the invention, each of the front end plate cutouts 60 and 61 has an angular extent of about 55°, the cutout 60 being separated from the cutout 61 by about 24° and being separated from the locating pin 63 by about 18°. In the rear end plate 70, the trailing edges of the cutouts 80 and 81 are respectively substantially axially aligned with the trailing edges of the cutouts 60 and 61, and are separated from each other by about the same angular distance as are the front cutouts 60 and 61. However, while the rear cutout 81 has an angular extent of about 55°, the same as the corresponding front cutout 61, the rear cutout 80 has an angular extent of only about 45°, thereby accounting for the 10° offset between the front and rear exhaust passages. Preferably, each of the outlet ports 78 and 79 in the rear end plate 70 has an angular extent slightly greater than that of the corresponding cutouts 80 and 81.

From the foregoing, it can be seen that there has been provided an improved dual exhaust air motor assembly which ensures substantial exhaust air flow from both the front and rear ends of the air motor assembly, thereby providing effective cooling at both the front and rear ends of the assembly, while avoiding any buildup of back pressure.

We claim:

1. In a fluid operated rotary motor including a liner having a cylindrical bore therethrough, a rotor having radially slidable vanes and being eccentrically mounted in the cylindrical bore, first and second end plates respectively mounted at first and second ends of the liner and rotatably supporting the rotor, and a fluid inlet port communicating with the interior of the cylindrical bore adjacent to the first end of the liner, the improvement comprising: exhaust structure defining first and second exhaust passages communicating with the bore respectively adjacent to the first and second ends of the liner, said second end plate having an axially inner surface, said inner surface having a recess formed therein but not extending therethrough and defining a portion of said second exhaust passage such that said second exhaust passage does not extend through or forwardly of said second end plate, said exhaust structure including proportioning means for ensuring that substantial fluid is exhausted from the bore through each of said first and second exhaust passages.

2. The motor of claim 1, wherein the first and second end plates respectively have first and second exhaust ports formed therein which respectively form portions of said first and second exhaust passages.

3. The motor of claim 1, and further comprising a housing surrounding the liner and cooperating therewith to define therebetween an annular chamber around the outside of the liner.

4. The motor of claim 3, wherein said exhaust structure includes means providing communication between the cylindrical bore and the annular chamber so that the annular chamber forms a portion of said second exhaust passage.

5. The motor of claim 1, wherein said first and second exhaust passages have a common portion adjacent to the first end of the liner.

6. The motor of claim 1, and further comprising fluid supply apparatus defining a fluid supply path communicating with the inlet port, and fluid exhaust apparatus defining a fluid exhaust path spaced radially outwardly of said fluid supply path and communicating with said exhaust passages.

7. The motor of claim 6, wherein said fluid supply apparatus includes a control valve for opening and closing said fluid supply path.

8. In a fluid operated rotary motor including a liner having a cylindrical bore therethrough, a rotor having radially slidable vanes and being eccentrically mounted in the cylindrical bore of the liner, first and second end plates respectively mounted at first and second ends of the liner and rotatably supporting the rotor, the vanes cooperating with the rotor and the liner to define a plurality of rotating variable volume fluid compartments, and a fluid inlet port communicating sequentially with the fluid compartments adjacent to the first end of the liner, the improvement comprising: exhaust structure defining first and second exhaust passages communicating with the fluid compartments respectively adjacent to the first and second ends of the liner and so disposed that each of the fluid compartments communicates with said second exhaust passage before it communicates with said first exhaust passage during each revolution of the rotor.

9. The motor of claim 8, wherein said exhaust passages are disposed so that the fluid compartments communicate with the second exhaust port prior to their communication with the first exhaust port by a time period which is a predetermined percentage of the time required for one complete revolution of the rotor.

10. The motor of claim 8, wherein said first and second exhaust passages are so disposed that during a predetermined portion of each revolution of the rotor they communicate simultaneously with each of the fluid compartments.

11. The motor of claim 8, wherein the first and second end plates respectively have first and second exhaust ports formed therein which respectively form portions of said first and second exhaust passages.

12. The motor of claim 11, wherein each of said first and second exhaust ports has a leading edge and an angular extent from said leading edge in the direction of rotation of the rotor, the leading edge of said first exhaust port trailing the leading edge of said second exhaust port in the direction of rotation of the rotor by a predetermined offset angle.

13. The motor of claim 12, wherein said offset angle is approximately 10°.

14. The motor of claim 8, and further comprising a housing surrounding the liner and cooperating therewith to define an annular chamber therebetween around the liner, said exhaust structure including means providing communication between said annular chamber and the cylindrical bore so that said annular chamber forms a portion of said exhaust passage.

15. The motor of claim 8, and further comprising locating means providing engagement between the liner and the end plates to prevent relative rotational movement thereof.

16. The motor of claim 8, wherein said exhaust structure includes means defining a portion of said second exhaust passages extending along substantially the entire length of the liner.

* * * * *